US011963588B2

(12) United States Patent
Owensby

(10) Patent No.: US 11,963,588 B2
(45) Date of Patent: Apr. 23, 2024

(54) WRIST-WORN DEVICE

(71) Applicant: Matthew Owensby, Atlanta, GA (US)

(72) Inventor: Matthew Owensby, Atlanta, GA (US)

( * ) Notice: Subject to any disclaimer, the term of this patent is extended or adjusted under 35 U.S.C. 154(b) by 41 days.

(21) Appl. No.: 15/685,574

(22) Filed: Aug. 24, 2017

(65) Prior Publication Data

US 2019/0059527 A1 Feb. 28, 2019

(51) Int. Cl.
*A44C 5/00* (2006.01)
*A44C 25/00* (2006.01)

(52) U.S. Cl.
CPC ..... *A44C 5/0015* (2013.01); *A44C 5/0053* (2013.01)

(58) Field of Classification Search
CPC .... A44C 5/0015; G06M 1/041; G06M 1/143; A63H 33/22
USPC ..... 63/40
See application file for complete search history.

(56) References Cited

U.S. PATENT DOCUMENTS 95,389 A * 9/1869 Sickels ..... G06M 1/143 235/143
566,617 A * 8/1896 Patterson ..... A44C 3/001 40/1.6
1,203,644 A * 11/1916 Morrison ..... G06M 1/143 235/134
1,486,135 A * 3/1924 Hagel ..... G06M 1/041 235/91 R
1,614,712 A * 1/1927 Cannon ..... G06M 1/143 235/131 M
1,929,622 A * 10/1933 Carlson ..... G06M 1/143 235/137
2,046,810 A * 7/1936 Cannon ..... G06M 1/041 235/1 D
2,522,734 A * 9/1950 Wood ..... G06M 1/041 377/92
2,845,226 A * 7/1958 Cummings ..... G06M 1/143 235/117 R
3,131,860 A * 5/1964 McKean ..... G06M 1/041 235/118
3,380,654 A * 4/1968 Williams ..... G06M 1/143 235/143
3,458,127 A * 7/1969 Hermann ..... G01C 22/00 235/95 R
4,077,237 A * 3/1978 Loper ..... A44C 25/007 63/31

(Continued)

OTHER PUBLICATIONS

Mike Yamamoto, "A watch with a built-in slot machine", Apr. 18, 2007, C/Net. (Year: 2007).*
Appendix A Definition—sector.*

*Primary Examiner* — Emily M Morgan
(74) *Attorney, Agent, or Firm* — Ballard Spahr LLP

(57) ABSTRACT

Provided are devices that can comprise a rotatable image wheel. The rotatable image wheel can comprise a plurality of image panels arranged radially around a central axis and radially offset relative to the central axis. The rotatable image wheel can also be rotatable about the central axis. The device can further comprise a face plate disposed coaxially with the rotatable image wheel and arranged to cover a portion of the rotatable image wheel. The face plate can describe an aperture radially offset with respect to the central axis. The device also comprises an actuator mechanically coupled to the rotatable image wheel and configured for causing rotation of the rotatable image wheel about the central axis relative to the face plate.

8 Claims, 3 Drawing Sheets

(56) References Cited

U.S. PATENT DOCUMENTS

| | | | | | |
|---|---|---|---|---|---|
| 4,681,459 | A * | 7/1987 | Nabeyama | G04B 19/268 | 273/161 |
| 4,766,579 | A * | 8/1988 | Sporring | G04B 19/25 | 368/15 |
| 5,023,849 | A * | 6/1991 | Vaucher | G04B 19/26 | 368/15 |
| 5,934,672 | A * | 8/1999 | Sines | G07F 17/3211 | 273/138.1 |
| 2003/0210613 | A1 * | 11/2003 | Bloch | G04G 9/02 | 368/223 |
| 2014/0269218 | A1 * | 9/2014 | Herold | G04B 47/00 | 368/10 |

* cited by examiner

WRIST-WORN DEVICE

BACKGROUND

Wrist-worn devices are an important source of expression of individuality for both men and women. Wearers choose one or more wrist-worn devices to enhance personal style. Wrist-worn jewelry is commonplace among men and women. For example, bracelets allow a wearer some degree of personal expression. However, bracelets typically are static objects, and not capable of adapting to the wearer's mood, whims, etc. Even charm bracelets, which can be altered by addition of charms, typically do not allow for minute-to-minute personalization. Other user devices such as smart phones, smartwatches, and other wearable electronic devices allow for personalization using display screens (e.g., liquid crystal displays, organic light emitting diode displays, and the like). However, many wearers prefer mechanical devices for aesthetic reasons. Further, electronic devices may not be permitted in certain areas (e.g., high-security areas) and may not be practical for all applications (e.g., long times away from a charging device).

Accordingly, there is a need for improved customizability of mechanical wrist-worn devices. These and other difficulties are addressed in the following description.

BRIEF SUMMARY

It is to be understood that both the following general description and the following detailed description are exemplary and explanatory only and are not restrictive. Provided are wrist-worn devices.

In an aspect, a device can comprise a rotatable image wheel. The rotatable image wheel can comprise a plurality of image panels arranged radially around a central axis and radially offset relative to the central axis. The rotatable image wheel can also be rotatable about the central axis. The device can further comprise a face plate disposed coaxially with the rotatable image wheel and arranged to cover a portion of the rotatable image wheel. The face plate can describe an aperture radially offset with respect to the central axis. The device also comprises an actuator mechanically coupled to the rotatable image wheel and configured for causing rotation of the rotatable image wheel about the central axis relative to the face plate.

In another aspect, a device can comprise a first rotatable image wheel and a second rotatable image wheel. The first rotatable image wheel can comprise a first plurality of image panels arranged radially around a first axis, each of the first plurality of image panels being radially offset relative to the first axis. The first rotatable image wheel can be rotatable about the first axis. The second rotatable image wheel can comprise a second plurality of image panels arranged radially around a second axis, each of the second plurality of image panels being radially offset relative to the second axis. The second rotatable image wheel can be rotatable about the second axis. The device can further comprise a face plate arranged to cover at least a portion of the first image wheel and the second rotatable image wheel. The face plate can describe a first aperture aligned with at least a portion of the first rotatable image wheel and a second aperture aligned with at least a portion of the second rotatable image wheel. The device can also comprise an actuator mechanically coupled to at least the first rotatable image wheel. The actuator can be configured for causing rotation of the first rotatable image wheel about the first axis.

In yet another aspect, a device can comprise a rotatable image wheel. The rotatable image wheel can comprise a plurality of image panels arranged radially around an axis of rotation and radially offset relative to the axis of rotation, and the rotatable image wheel can be rotatable about the axis of rotation. The device also can comprise a face plate arranged to cover at least a portion of the rotatable image wheel. The face plate can describe an aperture aligned with a portion of the rotatable image wheel. The device also can comprise an actuator mechanically coupled to the rotatable image wheel and configured for causing rotation of the rotatable image wheel about the axis of rotation.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
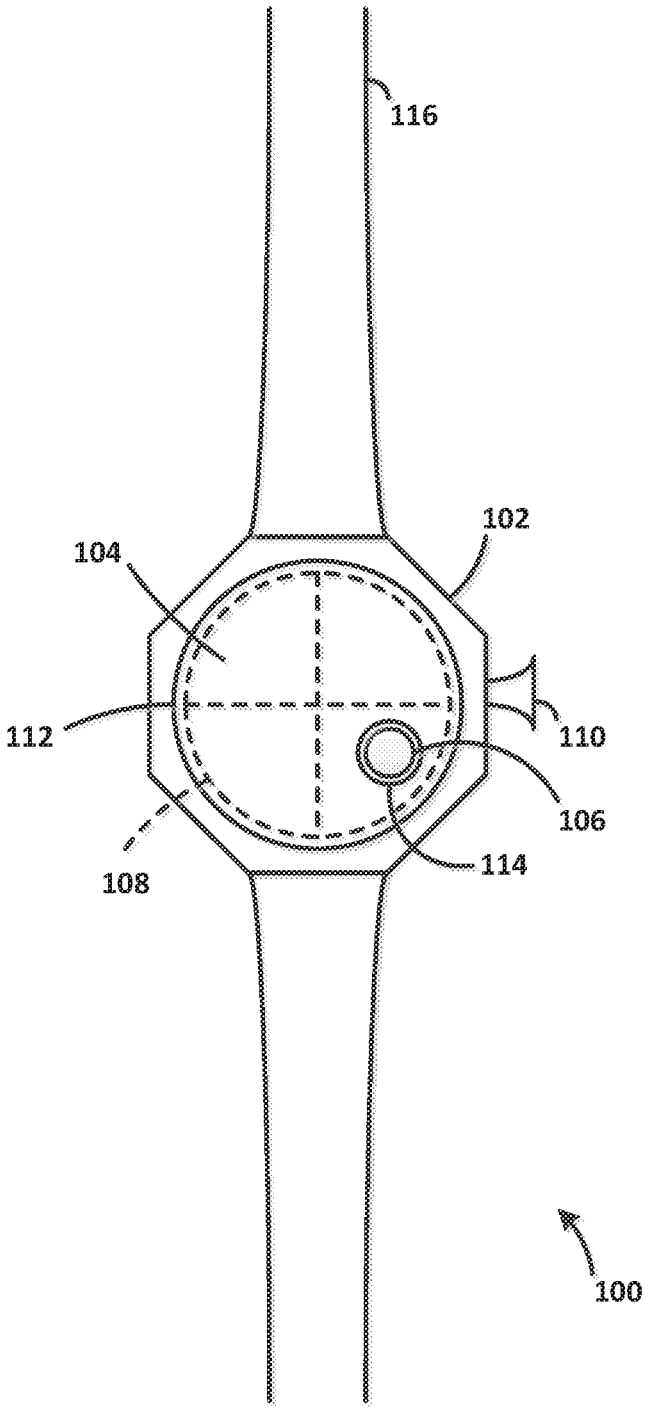
FIG. 1 is a plan view of an embodiment of the wrist-worn device.

Before the present methods and devices are disclosed and described, it is to be understood that the methods and devices are not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and devices. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems.

The present methods and devices may be understood more readily by reference to the following detailed description of preferred embodiments and the examples included therein and to the Figures and their previous and following description.

The wrist-worn device can be a purely mechanical piece of wrist attire, comprising no batteries or electronic displays. In some aspects, the wrist-worn device serves a purely decorative function, and does not tell time. In some aspects, the wrist-worn device can comprise a decorative face and one or more actuators or plungers that can be used to cycle through a plurality of visual effects on the face of the wrist-worn device.

In some aspects, the wrist-worn device is worn on a wearer's wrist, and allows the wearer to modify the image displayed by the device through actuation of an actuator or plunger on a periphery of the device. In some aspects, the device can include a face plate that comprises a relatively large, static image thereon. The face plate can describe one or more apertures. Each aperture can allow a portion of one or more rotatable image wheels to be visible therethrough on the watch face. The one or more rotatable image wheels can be rotated to customize the overall image presented by a combination of the face plate and the one or more rotatable image wheels and the face plate.

In some aspects, each one of the one or more image wheels can be separately controlled by a corresponding actuator or plunger. For example, a first image wheel can be controlled by a first actuator and a second image wheel can be controlled by a second actuator. In other aspects, the one or more image wheels can comprise a plurality of image wheels, and all of the plurality of image wheels can be controlled by a single actuator. For example, depressing the plunger can cause all of the plurality of image wheels to rotate. In some aspects, all of the plurality of image wheels can be rotated by the same amount each time the actuator is actuated (e.g., depressed). In other aspects, actuating the actuator can cause each of the plurality of image wheels to rotate by a different amount and/or at a different rate.

Turning now to FIG. 1, a first exemplary wrist-worn device 100 is shown. In some aspects, a housing or casing 102 can at least partially surround the device, exposing a face plate 104. In some aspects, the casing 102 can comprise a metal casing, such as stainless steel, titanium, aluminum, gold, silver, or alloys comprising one or more of those metals. In other aspects, the casing 102 can be formed from plastic, glass, ceramic, or other structurally sound materials. The face plate 104 can comprise a generally planar plate that covers at least a portion of the wrist-worn device 100. In some aspects, the face plate 104 can be generally circular. In other aspects, the face plate 104 can be generally rectangular, square, or any other shape. The face plate can comprise a decorative image.

In some aspects, the face plate 104 can further comprise an aperture 106. The aperture 106 can be radially offset from the center of the face plate 104. In some aspects, the aperture 106 can expose at least a portion of an image wheel 108. In some aspects, the aperture 106 can define a void in a material that forms the face plate 104. In other aspects, the aperture 106 can define a portion of the face plate 104 that is comprised of a transparent or semi-transparent material. The image wheel 108 can be a substantially circular wheel comprising a plurality of sections, with each section comprising a different image, pattern, and/or color. In some aspects, the different images, patterns, and/or colors on the image wheel 108 can be associated with the decorative image on the face plate 104. For example, the rotatable image wheel 108 can comprise a plurality of image panels arranged radially around a central axis and radially offset relative to the central axis. In some aspects, at least a portion of the image wheel 108 can be transparent or semi-transparent, allowing one or more designs covered by the image wheel 108 to be viewed by a viewer. In some aspects, the central axis of the image wheel 108 can be substantially orthogonal to a circular surface of the image wheel 108. The central axis of the image wheel 108 can be parallel with (e.g., extending in parallel, extending coaxially, etc.) an axis that extends orthogonally from the face plate 104. In some aspects, the central axis of the image wheel 108 can extend through a center of the face plate 104. In other aspects, the central axis of the image wheel 108 can be offset relative to the center of the face plate 104.

In some aspects, the image wheel 108 can be rotated by an actuator 110 in communication with the image wheel 108 and extending peripherally from the casing 102. The actuator 110 can facilitate rotation of the image wheel 108 about the axis. For example, actuation (e.g., depression) of the actuator 110 can cause the image wheel 108 to rotate by a predefined amount. In some aspects, the pre-defined amount can be associated with a number of sections of the image wheel. For example, when the image wheel 108 comprises four sections, each actuation of the actuator 110 can rotate the image wheel 108 by 90° (e.g., one quarter rotation). In other aspects, the image wheel 108 can be biased to rotate when not restricted by the actuator 110. For example, the image wheel 108 can be biased to spin using a bias spring, and prevented from spinning by a catch attached to the actuator 110. Actuating (e.g., depressing) the actuator 110 can disengage the catch allowing the image wheel 108 to spin until the actuator is de-actuated (e.g., until a wearer ceases to apply force to the actuator 110). In this way, the rotatable image wheel can be rotated randomly or pseudo-randomly. In some aspects, the rotation can be caused by actuation of a mechanical movement by the actuator 110, as is known in the art. For example, the mechanical movement can comprise a ratchet wheel and spring.

In some aspects, the actuator 110 can be activated by a user. For example, the actuator 110 can be activated based on a user's mood, whims, feelings, etc. In other aspects, the actuator can be activated to select a color that suits the user's mood or coordinates with a user's clothing and/or accessories.

In some aspects, the face plate 106 and image wheel 108 can be covered by a lens 112. The lens 112 can be formed from glass, plastic, crystal, or other substantially transparent material. The lens 112 can be attached to the casing 102 to cover and help protect the face plate 104. In some aspects, the lens 112 can comprise a magnifying portion 114 radially offset with respect to the center of the lens 112 and at least partially aligned with the aperture 106.

In some aspects, the wrist-worn device 100 can further comprise a wrist strap 116 attached to the casing 102. The wrist strap 116 can be formed from any flexible material suitable for use securing the device to the wearer's wrist. For example, the wrist strap can be formed from one or more of leather, plastic, rubber, metal links, and the like.

Figure 2:
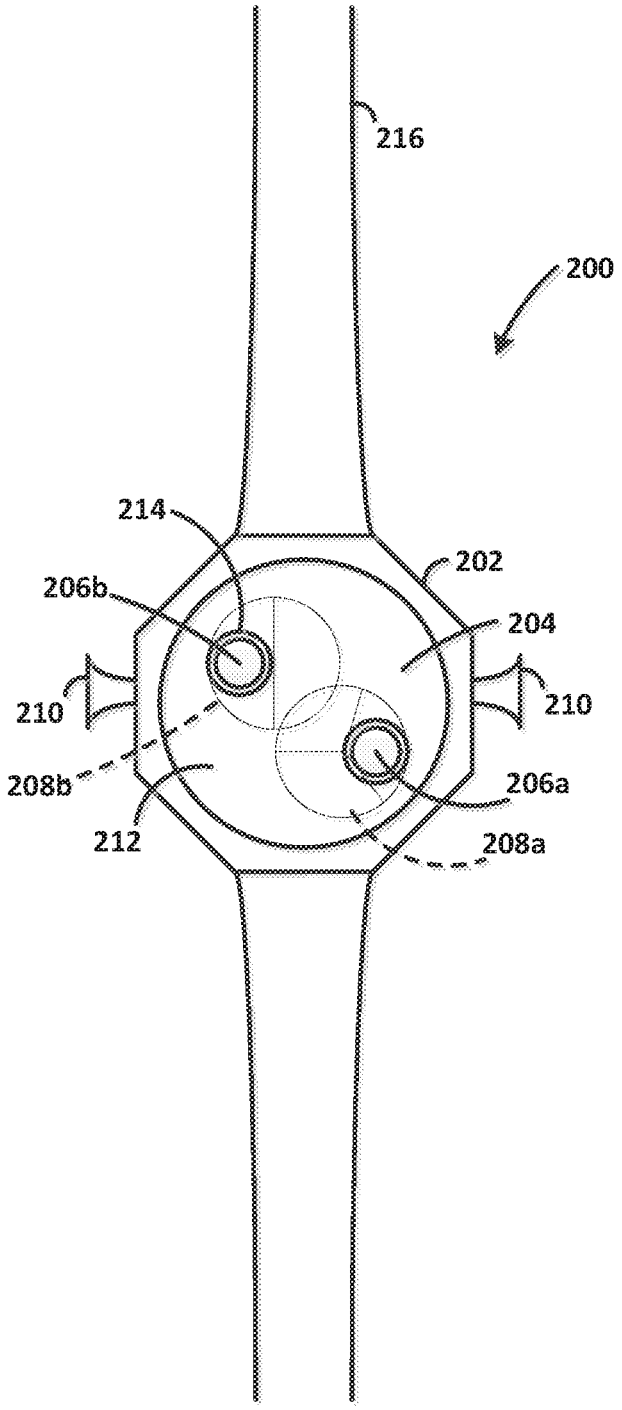
FIG. 2 is a plan view of another embodiment of the wrist-worn device.

FIG. 2 shows a second example of a wrist-worn device 200. In some aspects, a housing or casing 202 can at least partially surround the device, exposing a face plate 204. In some aspects, the casing 202 can comprise a metal casing, such as stainless steel, titanium, aluminum, gold, silver, or alloys comprising one or more of those metals. In other aspects, the casing 202 can be formed from plastic, glass, ceramic, or other structurally sound materials. The face plate 204 can comprise a generally planar plate that covers at least a portion of the wrist-worn device 200. In some aspects, the face plate 204 can be generally circular. In other aspects, the face plate 204 can be generally rectangular, square, or any other shape. The face plate 204 can comprise a decorative image.

In some aspects, the face plate 204 can further comprise a plurality of apertures 206. For example, the face plate can describe a first aperture 206*a* and a second aperture 206*b*. While FIG. 2 shows a face plate 204 comprising two apertures 206, more (or fewer) apertures are contemplated. Each of the apertures 206 can be radially offset from the center of the face plate 204. In some aspects, each of the apertures 206 can expose at least a portion of a corresponding image wheel 208. For example, the first aperture 206*a* can expose a portion of the first image wheel 208*a*, and the second aperture 206*b* can expose a portion of the second image wheel 208*b*. Each image wheel 208 can be substantially circular, comprising a plurality of sections with each section comprising a different image, pattern, and/or color. In some aspects, the different images, patterns, and/or colors on the plural image wheels 208 can be associated with the decorative image on the face plate 204. For example, the decorative image on the face plate 204 can comprise a face, with a first aperture 206*a* in a portion of the face where a mouth would conventionally be positioned, and a second aperture 206*b* where the eyes would conventionally be positioned; the first image wheel 208*a* can comprise a plurality of images of a mouth, disposed such that one of the plurality of images is viewable through the first aperture 206*a*; the second image wheel 208*b* can comprise a plurality of images of eyes, such that one of the plurality of images of eyes is viewable through the second aperture 206*b*. In some aspects, the first image wheel 208*a* and the second image wheel 208*b* can comprise different numbers of sections. For example, as shown in FIG. 2, the first image wheel 208*a* comprises three sections and the second image wheel 208*b* comprises two sections. In other aspects, the first image wheel 208*a* and the second image wheel 208*b* can comprise the same number of sections.

Each of the rotatable image wheels 208 can comprise a plurality of image panels arranged radially around a central axis and radially offset relative to the central axis. In some aspects, the central axis of each image wheel 208 can be substantially orthogonal to a circular surface of the image wheel 208. The central axis of the image wheels 208 can be parallel with (e.g., extending in parallel, extending coaxially, etc.) an axis that extends orthogonally from the face plate 204.

In some aspects, two or more of the plurality of image wheels 208 can be arranged concentrically. At least a portion of one or more (e.g., each) of the two or more image wheels 208 can be transparent or semi-transparent, allowing one or more designs covered by the image wheel 208 to be viewed by a viewer. In some aspects, the plurality of image wheels 208 can comprise wheels having differing radii, arranged concentrically such that the wheel 208 having the largest radius is furthest from the faceplate 204 and the wheel 208 having the smallest radius is nearest to the faceplate 204. In some aspects, the two or more concentric image wheels 208 can cooperate to display a single image.

In some aspects, each of the two or more concentric image wheels can be independently rotatable (e.g., the two or more concentric wheels 208 can be operably connected to independent corresponding actuators 210 to independently control each of the two or more wheels 208. In other aspects, each of the two or more concentric wheels 208 can be operably connected to a single actuator 210 that controls all of the two or more concentric wheels. For example, the actuator 210 can cause rotation of each of the two or more wheel 208 in the same direction or in different (e.g., opposing) directions and or in different amount (e.g., advancing a first wheel by one panel and a second wheel by two panels).

In some aspects, the image wheels 208 can be rotated by one or more actuators 210, each of the actuators 210 in communication with one or more of the image wheels 208 and extending peripherally from the casing 202. Each of the one or more actuators 210 can facilitate rotation of one or more of the image wheels 208 about their respective axes.

In some aspects, the one or more actuators 210 can comprise a single actuator. Actuation (e.g., depression) of the actuator 210 can cause the first image wheel 208*a* to rotate by a first predefined amount and the second image wheel 208*b* to rotate by a second predefined amount. In some aspects, the predefined amount can be associated with a number of sections of the corresponding image wheel. For example, when the first image wheel 208*a* comprises three sections, each actuation of the actuator 210 can rotate the first image wheel 208*a* by 120° (e.g., one third rotation). When the second image wheel 208*b* comprises two sections, each actuation of the actuator 210 can rotate the second image wheel 208*b* by 180° (e.g., one half rotation). In other aspects, the image wheels 208 can be biased to rotate when not restricted by the actuator 210. For example, the image wheels 208 can be biased to spin using a bias spring, and prevented from spinning by a catch attached to the actuator 210. Actuating (e.g., depressing) the actuator 210 can disengage the catch allowing the image wheels 208 to spin until the actuator is de-actuated (e.g., until a wearer ceases to apply force to the actuator 210). In this way, the rotatable image wheels 208 can be rotated randomly or pseudo-randomly. In some aspects, actuation of the actuator 210 can cause rotation of each of the two or more wheels 208 in the same direction or in different (e.g., opposing) directions and or in different amount (e.g., advancing a first wheel by one panel and a second wheel by two panels). In some aspects, the rotation can be caused by actuation of a mechanical movement by the actuator 210, as is known in the art. For example, the mechanical movement can comprise a ratchet wheel and spring.

In other aspects, the one or more actuators 210 can comprise a first actuator and a second actuator. Actuation (e.g., depression) of the first actuator can cause the first image wheel 208*a* to rotate by a first predefined amount. Actuation of the second actuator can cause the second image wheel 208*b* to rotate by a second predefined amount. In some aspects, the first and second predefined amounts can be associated with a number of sections of the corresponding image wheel. For example, when the first image wheel 208*a* comprises three sections, each actuation of the first actuator 210 can rotate the first image wheel 208*a* by 120° (e.g., one third rotation). When the second image wheel 208*b* comprises two sections, each actuation of the second actuator 210 can rotate the second image wheel 208*b* by 180° (e.g., one half rotation). Alternatively one or more of the first image wheel 208*a* and the second image wheel 208*b* can be biased to rotate when not restricted by an actuator 210. For example, the first image wheel 208*a* can be biased to spin using a bias spring, and prevented from spinning by a catch attached to the first actuator 210. Actuating (e.g., depressing) the first actuator 210 can disengage the catch allowing the first image wheel 208*a* to spin until the first actuator is de-actuated (e.g., until a wearer ceases to apply force to the first actuator 210). The second image wheel 208*b* can be biased to spin using a bias spring, and prevented from spinning by a catch attached to the second actuator 210. Actuating (e.g., depressing) the second actuator 210 can disengage the catch allowing the second image wheel 208*b* to spin until the second actuator 210 is de-actuated (e.g., until a wearer ceases to apply force to the second actuator 210). In this way, one or more of the rotatable image wheels 208 can be rotated randomly or pseudorandomly.

In some aspects, the one or more actuators 210 can be activated by a user. For example, the one or more actuators 210 can be activated based on a user's mood, whims, feelings, etc. In other aspects, the one or more actuators 210 can be activated to select a color that suits the user's mood or coordinates with a user's clothing and/or accessories. In some aspects, a user may choose to activate all or less than all of the one or more actuators 210.

In some aspects, the face plate 206 and image wheels 208 can be covered by a lens 212. The lens 212 can be formed from glass, plastic, crystal, or other substantially transparent material. The lens 212 can be attached to the casing 202 to cover and help protect the face plate 204. In some aspects, the lens 212 can comprise a magnifying portion 214 radially offset with respect to the center of the lens 212 and at least partially aligned with the apertures 206.

In some aspects, the wrist-worn device 200 can further comprise a wrist strap 216 attached to the casing 202. The wrist strap 216 can be formed from any flexible material suitable for use securing the device to the wearer's wrist. For example, the wrist strap can be formed from one or more of leather, plastic, rubber, metal links, and the like.

Figure 3:
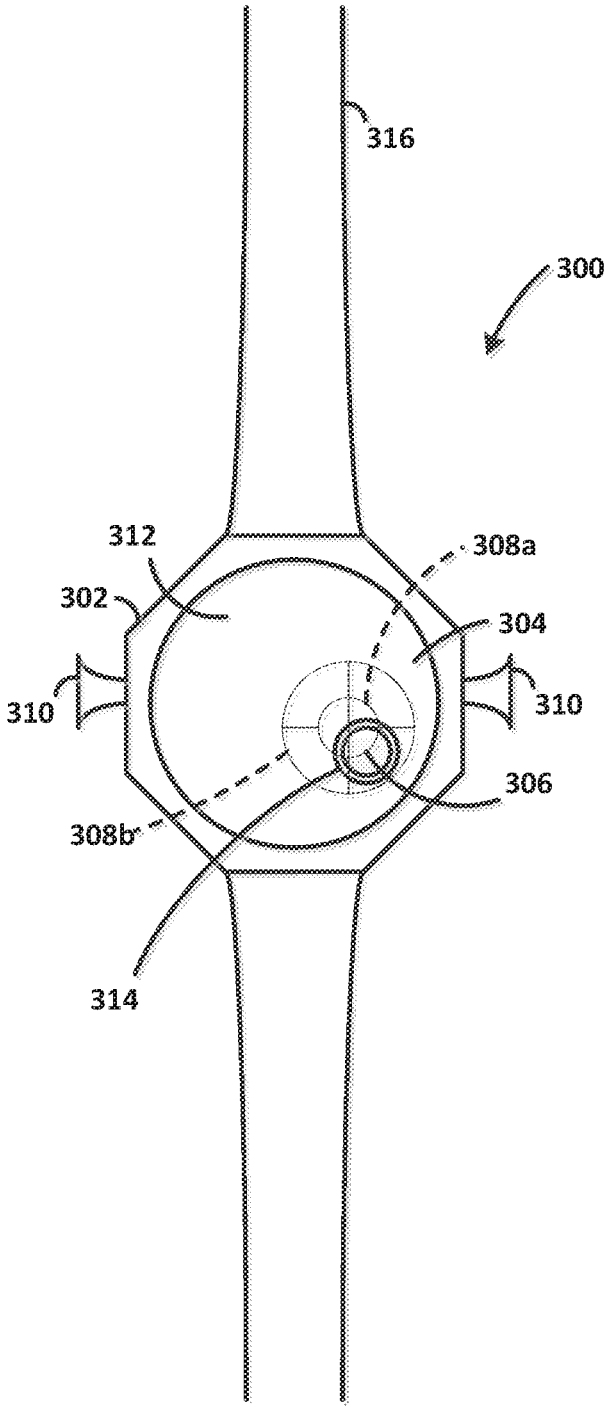
FIG. 3 is a plan view of another embodiment of the wrist-worn device.

FIG. 3 shows a second example of a wrist-worn device 300. In some aspects, a housing or casing 302 can at least partially surround the device, exposing a face plate 304. In some aspects, the casing 302 can comprise a metal casing, such as stainless steel, titanium, aluminum, gold, silver, or alloys comprising one or more of those metals. In other aspects, the casing 302 can be formed from plastic, glass, ceramic, or other structurally sound materials. The face plate 304 can comprise a generally planar plate that covers at least a portion of the wrist-worn device 300. In some aspects, the face plate 304 can be generally circular. In other aspects, the face plate 304 can be generally rectangular, square, or any other shape. The face plate 304 can comprise a decorative image.

In some aspects, the face plate 304 can further comprise one or more apertures 306. While FIG. 3 shows a face plate 304 comprising one aperture 306, more apertures are contemplated. Each of the apertures 306 can be radially offset from a center of the face plate 304. Each of the apertures can be included in the decorative image of the face plate 304. In some aspects, each of the apertures 306 can expose at least a portion of a corresponding image wheel 308. Each image wheel 308 can be substantially circular, comprising a plurality of sections with each section comprising a different image, pattern, and/or color. In some aspects, the different images, patterns, and/or colors on the image wheels 308 can be associated with the decorative image on the face plate 304. In some aspects, the image wheel 308 can comprise a central disc 308*a* and one or more annular portions 308*b* that surround the central disc. The one or more annular portions 308*b* and the central disc 308*a* can be arranged substantially coaxially.

Each of the central disc 308*a* and the one or more annular portions 308*b* can comprise a plurality of image panels arranged radially around a central axis and radially offset relative to the central axis. In some aspects, the central disc 308*a* and the annular portion 308*b* can comprise different numbers of sections. For example, as shown in FIG. 3, the central disc 308*a* can comprise three sections and the annular portion 308*b* can comprise two sections. In other aspects, the central disc 308*a* and the annular portion 308*b* can comprise the same number of sections. In some aspects, the central axis of each of the central disc 308*a* and the one or more annular portions 308*b* can be substantially orthogonal to a circular surface of the image wheel 308. The central axis of the central disc 308*a* and the one or more annular portions 308*b* can be parallel with (e.g., extending in parallel, extending coaxially, etc.) an axis that extends orthogonally from the face plate 304. In some aspects, the central disc 308*a* and the one or more annular portions 308*b* can be arranged concentrically. At least a portion of one or more (e.g., each) of the central disc 308*a* and the one or more annular portions 308*b* can be transparent or semi-transparent, In some aspects, the central disc 308*a* and the one or more annular portions 308*b* can be rotated by one or more actuators 310, each of the actuators 310 in communication with one or more of the central disc 308*a* and the one or more annular portions 308*b* and extending peripherally from the casing 302. The one or more actuators 310 can facilitate rotation of one or more of the central disc 308*a* and the one or more annular portions 308*b* about their respective axes.

In some aspects, the central disc 308*a* and the one or more annular portions 308*b* can be independently rotatable (e.g., the central disc 308*a* and the one or more annular portions 308*b* can be operably connected to independent corresponding actuators 310 to independently control each of the central disc 308*a* and the one or more annular portions 308*b*). In other aspects, the central disc 308*a* and/or one or more of the one or more annular portions 308*b* can be operably connected to a single actuator 310 that controls the central disc 308*a* and the one or more annular portions 308*b*. For example, the actuator 310 can cause rotation of the central disc 308*a* and/or the one or more annular portions 308*b* in the same direction or in different (e.g., opposing) directions. Further, the actuator 310 can cause rotation of the central disc 308*a* and the one or more annular portions 308*b* by the same amount (e.g., advancing each of the central disc 308*a* and the one or more annular portions 308*b* by one section) or by differing amounts (e.g., advancing the central disc 308*a* by one section and the one or more annular portions 308*b* by two sections).

In some aspects, the one or more actuators 310 can comprise a single actuator. Actuation (e.g., depression) of the actuator 310 can cause the central disc 308*a* to rotate by a first predefined amount and the one or more annular portions 308*b* to rotate by a second predefined amount. In some aspects, the predefined amount can be associated with a number of sections of the corresponding image wheel. For example, when the central disc 308*a* comprises three sections, each actuation of the actuator 310 can rotate the central disc 308*a* by 120° (e.g., one third rotation). When the annular portion 308*b* comprises two sections, each actuation of the actuator 310 can rotate the annular portion 308*b* by 180° (e.g., one half rotation). In other aspects, the central disc 308*a* and the one or more annular portions 308*b* can be biased to rotate when not restricted by the actuator 310. For example, the of the central disc 308*a* and the one or more annular portions 308*b* can be biased to spin using a bias spring, and prevented from spinning by a catch attached to the actuator 310. Actuating (e.g., depressing) the actuator 310 can disengage the catch allowing the central disc 308*a* and the one or more annular portions 308*b* to spin until the actuator 310 is de-actuated (e.g., until a wearer ceases to apply force to the actuator 310). In this way, the central disc 308*a* and the one or more annular portions 308*b* can be rotated randomly or pseudorandomly. In some aspects, actuation of the actuator 310 can cause rotation of each of the central disc 308*a* and the one or more annular portions 308*b* in the same direction or in different (e.g., opposing) directions. In some aspects, the rotation can be caused by actuation of a mechanical movement by the actuator 310, as is known in the art. For example, the mechanical movement can comprise a ratchet wheel and spring.

In other aspects, the one or more actuators 310 can comprise a first actuator and a second actuator. Actuation (e.g., depression) of the first actuator can cause the central disc 308*a* to rotate by a first predefined amount. Actuation of the second actuator can cause at least one of the one or more annular portions 308*b* to rotate by a second predefined amount. In some aspects, the first and second predefined amounts can be associated with a number of sections of the corresponding image wheel. For example, when the central disc 308*a* comprises three sections, each actuation of the first actuator 310 can rotate the central disc 308*a* by 120° (e.g., one third rotation). When the annular portion 308*b* comprises two sections, each actuation of the second actuator 310 can rotate the annular portion 308*b* by 180° (e.g., one half rotation). Alternatively one or more of the central disc 308*a* and the one or more annular portions 308*b* can be biased to rotate when not restricted by an actuator 310. For example, the central disc 308*a* can be biased to spin using a bias spring, and prevented from spinning by a catch attached to the first actuator 310. Actuating (e.g., depressing) the first actuator 310 can disengage the catch allowing the central disc 308*a* to spin until the first actuator is de-actuated (e.g., until a wearer ceases to apply force to the first actuator 310). The annular portion 308*b* can be biased to spin using a bias spring, and prevented from spinning by a catch attached to the second actuator 310. Actuating (e.g., depressing) the second actuator 310 can disengage the catch allowing the annular portion 308*b* to spin until the second actuator 310 is de-actuated (e.g., until a wearer ceases to apply force to the second actuator 310). In this way, one or more of the central disc 308*a* and the one or more annular portions 308*b* can be rotated randomly or pseudorandomly.

In some aspects, the one or more actuators 310 can be activated by a user. For example, the one or more actuators 310 can be activated based on a user's mood, whims, feelings, etc. In other aspects, the one or more actuators 310 can be activated to select a color that suits the user's mood or coordinates with a user's clothing and/or accessories. In some aspects, a user may choose to activate all or less than all of the one or more actuators 310.

In some aspects, the face plate 306 and image wheels 308 can be covered by a lens 312. The lens 312 can be formed from glass, plastic, crystal, sapphire. or other substantially transparent material. The lens 312 can be attached to the casing 302 to cover and help protect the face plate 304. In some aspects, the lens 312 can comprise a magnifying portion 314 radially offset with respect to the center of the lens 312 and at least partially aligned with the aperture 306.

In some aspects, the wrist-worn device 300 can further comprise a wrist strap 316 attached to the casing 302. The wrist strap 316 can be formed from any flexible material suitable for use securing the device to the wearer's wrist. For example, the wrist strap can be formed from one or more of leather, plastic, rubber, metal links, and the like.

While the devices have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A device comprising:

a rotatable image wheel comprising a plurality of image panels arranged about a central axis in respective equal circular sectors, wherein each one of the respective equal circular sectors has a defined central angle, the rotatable image wheel shaped as a disc;

a face plate disposed coaxially with the rotatable image wheel, the face plate overlaying a portion of the rotatable image wheel and defining an aperture that is radially offset with respect to the central axis; and an actuator mechanically coupled to the rotatable image wheel and extending outwardly from a periphery of a casing that encompasses the rotatable image wheel, wherein the actuator causes the rotatable image wheel to rotate about the central axis relative to the face plate by a defined rotation angle in response to application of a force that depresses the actuator, the defined rotation angle being equal to a multiple of the defined central angle, wherein causing the rotatable image wheel to rotate comprises causing a first image panel of the plurality of image panels to rotate from a first one of the respective equal circular sectors to a second one of the respective equal circular sectors.

2. The device of claim 1, further comprising a cylindrical case at least partially surrounding the rotatable image wheel and the face plate, wherein the actuator extends outwardly from the cylindrical case.

3. The device of claim 2, further comprising a wrist strap attached to the cylindrical case.

4. The device of claim 1, further comprising a lens disposed coaxially with the rotatable image wheel and the face plate, the lens overlaying the face plate.

5. The device of claim 4, wherein the lens comprises a magnifying portion radially offset with respect to the central axis and at least partially aligned with the aperture.

6. The device of claim 1, wherein a number of image panels in the plurality of image panels is four, resulting in the defined central angle being equal to $\pi/2$ radians.

7. The device of claim 1, wherein a number of image panels in the plurality of image panels is three, resulting in the defined central angle being equal to $2\pi/3$ radians.

8. The device of claim 1, wherein a number of image panels in the plurality of image panels is two, resulting in the defined central angle being equal to $\pi$ radians.

* * * * *